United States Patent [19]

Del Tufo

[11] 4,346,360

[45] Aug. 24, 1982

[54] LOW PROFILE REED KEYSWITCH

[75] Inventor: Mark J. Del Tufo, Belleville, N.J.

[73] Assignee: Litton Business Systems, Inc., Morris Plains, N.J.

[21] Appl. No.: 145,512

[22] Filed: May 1, 1980

[51] Int. Cl.[3] ..... H01H 36/00

[52] U.S. Cl. ..... 335/205; 200/295

[58] Field of Search ..... 335/205, 206, 207; 200/83 L, 293, 294, 295

[56] References Cited

U.S. PATENT DOCUMENTS

| | | | |
|---|---|---|---|
| 2,304,061 | 12/1942 | Little | 335/206 |
| 3,829,803 | 8/1974 | Maeda | 335/205 |
| 4,211,991 | 7/1980 | Lombard et al. | 335/207 |

*Primary Examiner*—Harold Broome

*Attorney, Agent, or Firm*—Michael H. Wallach; Robert F. Rotella

[57] ABSTRACT

A low profile reed keyswitch which includes a magnetically actuated reed switch. The reed switch is mounted parallel to the keyswitch base on a retaining fixture which resistively holds the body of the reed switch. The leads of the reed switch freely pass through the base where they are available for direct connection to an external circuit. A permanent magnet is carried in a plunger which is spring biased away from the reed switch. The reed switch is actuated when an operator depresses the plunger to move the magnet toward the reed switch.

7 Claims, 2 Drawing Figures

LOW PROFILE REED KEYSWITCH

BACKGROUND OF THE INVENTION

1. Field of the Invention

This invention relates to electrical switches in general, and more particularly to keyswitches in which the change in location of a permanent magnet causes the actuation of a sealed, magnetic responsive reed switch.

2. Description of the Prior Art

It is known in the prior art to control the closure or opening of electrical circuits with sealed reed switches which are responsive to the pressure of a magnetic field. Switches embodying this form of construction typically are characterized by a permanent magnet which is moved toward or away from a reed switch by hand actuation of a plunger mechanism. Some examples of prior known switches embodying this form of construction are disclosed in U.S. Pat. Nos. 3,233,061; 3,283,274; 3,292,123; 3,462,719; 3,465,271; 3,533,028; 3,559,124; 3,613,038; 3,622,926; 3,652,963; 3,652,964; 3,698,531; 3,736,397; 3,810,052; 3,921,108; and 4,117,430.

While switches constructed in accordance with the prior art provide a reliable means for opening or closing an electrical circuit, they are frequently difficult to assemble due to the need for the body of the reed switch to be accurately positioned relative to the direction of travel of the actuating magnet to insure consistent contact closure for a specified distance of travel of the magnet. Some prior known switches have insured that the reed switch remained correctly positioned relative to the path of travel of the actuating magnet by soldering the semi-rigid electrical contact leads of the reed switch to the body or to a rigid appendage of the keyswitch. While such forms of construction insure that the reed switch remains immobile relative to the path of travel of the magnet, the assembly of the keyswitch requires that the reed switch must first be properly positioned and then the switch leads must be soldered or otherwise rigidly fastened to the keyswitch to insure continued reliable operation of the mechanism. Such an arrangement also requires a separate operation to electrically connect the keyswitch leads to an external circuit.

Keyswitches are also known in the prior art in which the body of the reed switch is mounted in a vertical orientation. Switches of this form of construction are unsuitable for applications in which an easily assembled keyswitch is required which has a small overall height and which will actuate upon small movements of the permanent magnet.

SUMMARY OF THE INVENTION

One object of this invention is to provide a keyswitch in which the body of the magnetically actuated reed switch is easily aligned with respect to the path of travel of the actuating magnet during the assembly of the keyswitch.

Another object is to provide a reed keyswitch which has a low profile.

It is also an object to provide a reed keyswitch in which the reed switch is held in accurate alignment without requiring that the leads of the reed switch be soldered to the keyswitch during the assembly operation.

Still another object is to provide a reed keyswitch which may be easily assembled from a minimum number of low tolerance parts.

The above objects and other advantages are achieved by molding or otherwise forming a keyswitch base having a retaining fixture rising therefrom which is positioned on the base to support the body of magnetically actuated reed switch in a substantially horizontal position. The retaining fixture includes a holding clip integrally formed thereon. The body of the reed switch is resistively engaged between a shelf on the fixture and the clip to accurately align the contact elements contained in reed switch and to thereafter prevent movement of the body of the reed switch. A spring biased plunger, having a vertically oriented open channel passing through the lower extremity thereof is aligned relative to the base so that the plunger may be moved toward and away from the base with the reed switch disposed within the channel. A permanet magnet is carried within a slot in the plunger. The plunger is spring biased away from the reed switch so that the magnetic field generated by the permanet magnet does not influence the reed switch until the keyswitch is actuated. Depression of the plunger by an operator causes the magnet to travel downwardly toward the reed switch, which is positioned so that the contact elements of the reed switch will be actuated by the proximity of the magnet to the reed switch when the plunger is in its lower position.

Since the connecting leads of the reed switch are not required to either support or properly locate the body of the reed switch, they may be freely passed through the base where they are available for attachment to an external circuit, as for example by wave soldering to a printed circuit board.

BRIEF DESCRIPTION OF THE DRAWINGS

The above and other objects of this invention be evident from an understanding of the preferred embodiment which is set forth in such detail as to enable those skilled in the relevant art to readily understand the function, operation, construction and advantages of it when read in conjunction with the accompanying drawings in which.

DESCRIPTION OF THE PREFERRED EMBODIMENT

Figure 1:
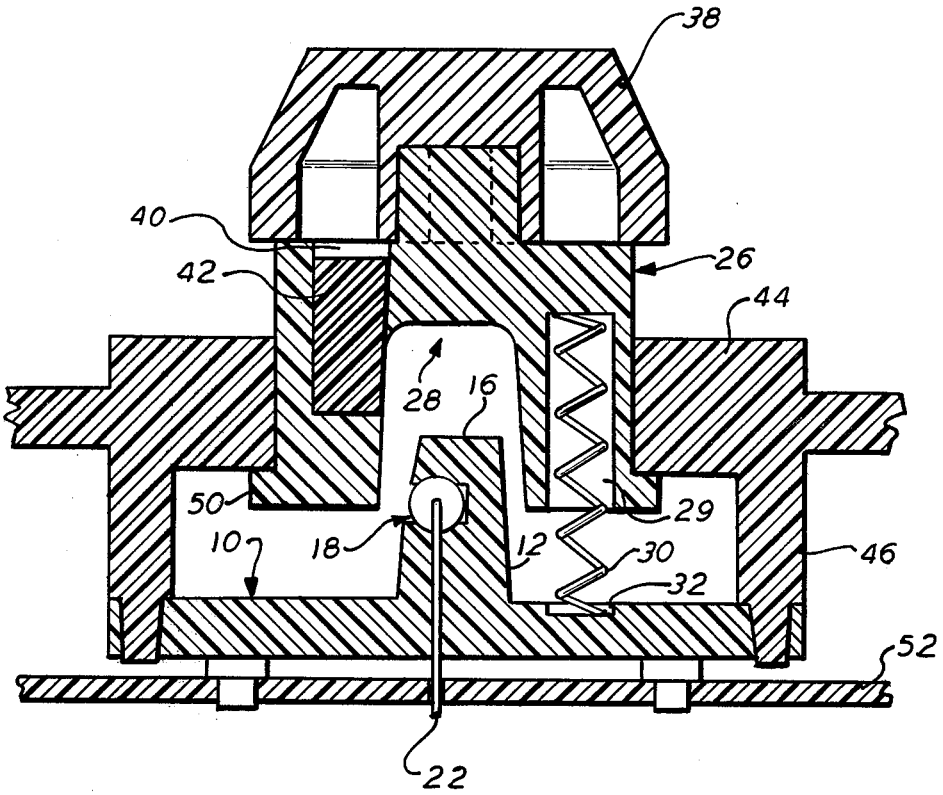
FIG. 1 is a disassembled perspective view of a reed keyswitch constructed in accordance with the teachings of this invention.
Figure 2:
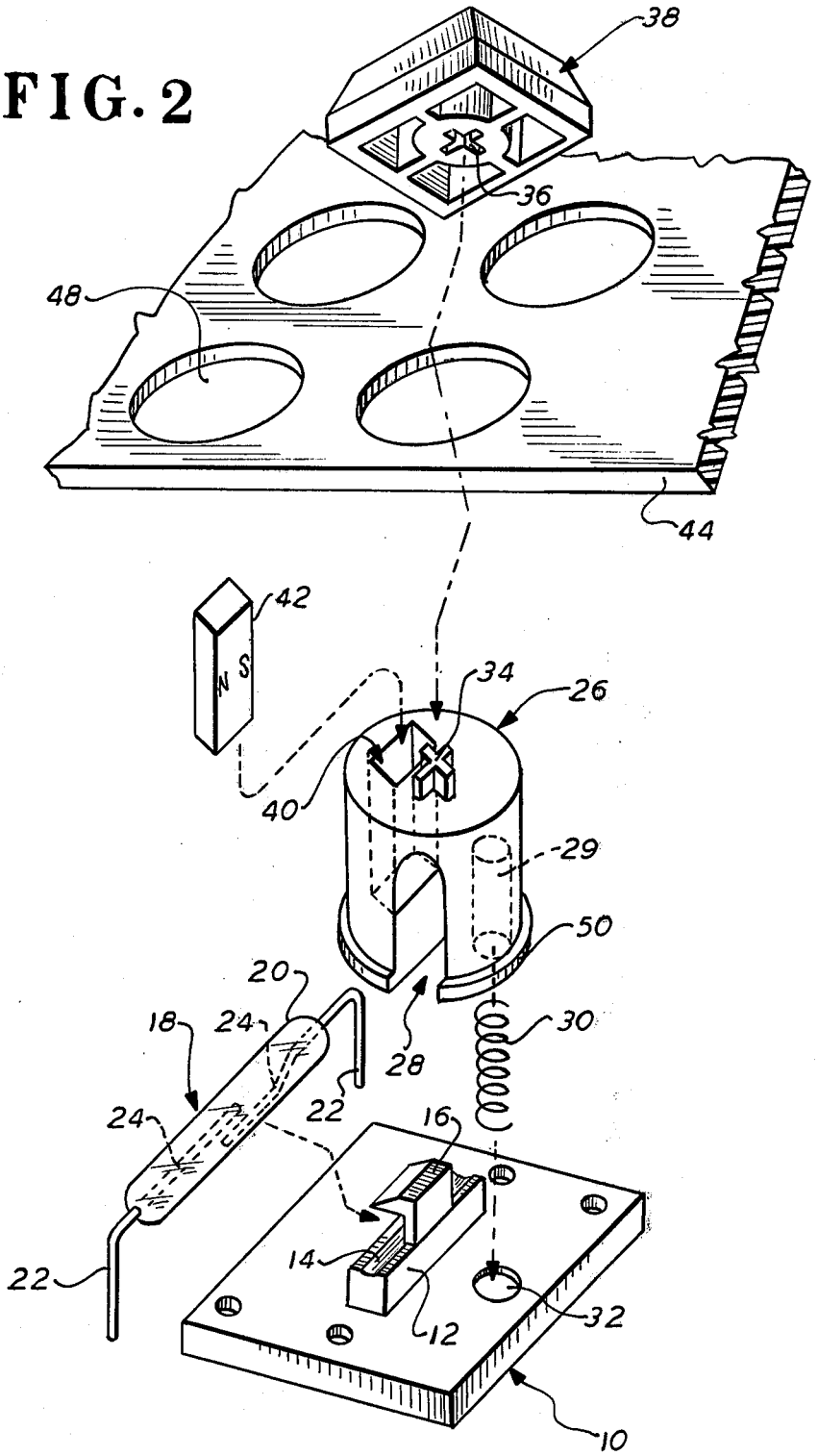
FIG. 2 is a side elevational view partly in section of the reed keyswitch of FIG. 1.

Referring to the drawings, FIG. 1 shows a disassembled perspective view of the low profile reed keyswitch forming the subject matter of this invention. The keyswitch includes a base 10 which may preferably be molded from an insulating plastic material. The base 10 is formed with a retaining fixture 12 thereon which preferably includes a longitudinal elevated shelf 14 and an L-shaped retaining clip 16 which rises above and overlies the shelf 14. Preferably the clip 16 is molded so that it may be flexed away from the shelf 14 so that a reed switch 18 having a body 20 and a pair of leads 22 may be retained in a horizontal position thereon, with the body 20 restrained between the shelf 14 and the clip 16.

The reed switch 18 includes a pair of contact elements 24 which are contained within the body 20 and which are an extension of the leads 22. Preferably the body 20 is hermetically sealed so that the elements 24 are in a controlled environment. The elements 24 are also preferably formed from a material which will permit them to be drawn into contact with each other when in the presence of a magnetic field. One example of a switch which may be used for the switch 18 whose characteristics are well known to those skilled in the art is manufactured by Standex Electronics, Inc. and is identified as part No. GRK-560. While the preferred embodiment is shown incorporating a reed switch 18 whose contacts are normally open, it is to be understood that a reed switch having normally closed contacts may be substituted therefor.

Preferably, a plunger 26 having a vertically oriented channel 28 at the lower extremity thereof is positioned over the reed switch 18 so that the plunger 26 may be moved in a vertical direction toward and away from the base 10 with the reed switch 18 sheltered within the channel 28. While the plunger 26 is shown having a circular cross-sectional shape, it may be formed in any shape which is convenient for manufacture and installation in a keyboard. The plunger 26 also includes a vertically oriented bore 29 which receives a coil spring 30. Preferably the spring 30 has one extremity thereof trapped on the base 10, as for example within a circular depression 32 formed in the base 10, so that the plunger 26 is normally biased away from the base 10 by the spring 30. The plunger 26 also includes a protruding rib 34 which rises from the upper extremity thereof and which is frictionally received within a complemental member 36 contained in a key 38 so that the key 38 may be retained on the plunger 26.

FIG. 1 also illustrates that the plunger 26 includes a vertically oriented slot 40. The slot 40 receives a permanent magnet 42 which is polarized across its face to define a North Pole and a South Pole. Preferably the magnet 42 is formed from a ferrite impregnated plastic compound. Preferably the slot 40 is open at the upper extremity thereof to permit the magnet 42 to be conveniently loaded into the plunger 26 during the assembly of the keyswitch.

The plunger 26 is constrained from movement in all but a vertical direction by a housing 44 which is spaced above the base 10 by a vertical wall 46. The wall 46 is retained to the base 10 by an suitable means, as for example by a tight press fit or by a cement bond. The housing 44 contains one or more spaced apertures 48 which each receive the body of one of more plungers 26. Preferably the lower extremity of the plunger 26 includes an annular ridge 50 which prevents the spring 30 from driving the plunger 26 above housing 44.

FIG. 1 illustrates that electrical connection between circuits on a printed circuit board 52 and the reed keyswitch 18 may be effected by soldering the leads 22 directly to the printed circuit board 52 by a wave soldering process or any other appropriate method. Since the body 20 of the switch 18 is firmly supported by the retaining fixture 12, movement of the leads 22 will not affect the location or alignment of the body 20, so that the leads 22 may be bent or otherwise oriented for optimum placement relative to the circuit elements on the printed circuit board 52 to which the leads are to be fastened.

The operation of the low profile reed keyswitch may best be seen by reference to FIG. 1. Before the switch is actuated, the plunger 26 is biased away from the base 10 by the spring 30. The magnet 42 is spaced apart from the reed elements 24 a sufficient distance so that the elements 24 remain unaffected by the magnetic field. When an operator depresses the key 38, the plunger 26 moves downwardly and carries the magnet 42 toward the body 20 of the reed switch 18. The elements 24 are magnetically drawn into contact with each other when the magnet 42 is brought to a location relative to the reed switch 18 so that the magnetic field may overcome the mechanical inertia of the elements 24 in a manner well known in the art. The elements 24 remain in a closed state until the key 38 is released, permitting the spring 30 to bias the magnet 42 carried in the plunger 26 away from the base 10.

It should be apparent that what has been disclosed herein is a simple and reliable low profile keyswitch which uses a minimum number of easily assembled parts, and which is particularly easy to electrically connect to a printed circuit board through the use of the leads of the magnetic reed switch. Numerous alterations of the structure herein disclosed may become apparent to those skilled in the art. However, it is to be understood that the present disclosure relates to a preferred embodiment of the invention which is for the purpose of illustration only and not to be construed as imposing a limitation on the scope of the invention. All modifications which do not depart from the spirit of the invention are intended to be included within the scope of the appended claims.

I claim:

1. A low-profile reed keyswitch comprising:
a base;
a magnetically actuated reed switch having a longitudinal body and at least a pair of leads entering said body;
fixture means fastened to said base for supporting and retaining said reed switch independent of the leads with the longitudinal body of said reed switch substantially parallel to said base and with the leads of said reed switch passing freely through said base, said fixture means having a resilient clip thereon, the body of said reed switch being retained by said fixture means and said clip;
plunger means spaced apart from said reed switch and having a vertical slot therein, said plunger means being moveable in a straight line to a first position near said base and to a second position away from said base;
a spring for biasing said plunger means toward said second position away from said base; and
permanent magnet means carried in said vertical slot of said plunger for movement with said plunger means, said permanent magnet means being moved to a position to actuate said reed switch when said plunger is moved to said first position near said base.

2. The arrangement as set forth in claim 1 wherein:
said fixture means is integrally formed with said base.

3. The arrangement as set forth in claim 1 wherein:
a housing having at least one aperture therein overlies said base, said plunger means passing through said at least one aperture of said housing.

4. The arrangement as set forth in claim 3 wherein:
said plunger means includes an annular rib around the lower extremity thereof, said annular rib restraining the upward travel of said plunger in said second position against said housing.

5. The arrangement as set forth in claim 1 wherein:
said plunger means includes a vertically oriented open channel at the lower extremity thereof, said reed switch being accomodated at least partially within said channel when said plunger is in said first position near said base.

6. The arrangement as set forth in claim 4 wherein:

said plunger means includes an operator-accessible key secured to said plunger above said housing, whereby depression of said key toward said housing operates said keyswitch.

7. A low-profile reed keyswitch comprising:

a base;

a magnetically actuated reed switch having a longitudinal body and at least one pair of leads entering said body;

a fixture for supporting said reed switch independent of the leads with the longitudinal body of said reed switch substantially parallel to said base, said fixture including a resilient clip, the body of said reed switch being rigidly restrained to said fixture by said resilient clip;

plunger means overlying said reed switch, said plunger means being moveable in a straight line to a lower position near said base and to an upper position away from said base, said plunger means having a vertically oriented open channel at the lower extremity thereof to accommodate at least partially said reed switch within said open channel when said plunger is near said base;

a rectangular permanent magnet having a vertical dimension, said rectangular permanent magnet being carried in said plunger means and moveable in a vertical direction toward and away from said reed switch by the movement of said plunger means toward and away from said base, said rectangular permanent magnet having a face parallel to the vertical direction of movement of said plunger means and parallel to the longitudinal body of said reed switch, with said face polarized to define continuous South and North poles along the vertical dimension;

spring means to bias said plunger means away from said base;

said reed switch being actuated by said permanent magnet when said plunger means is in the lower position near the base and being unactuated when said plunger is in the upper position away from said base.

* * * * *

UNITED STATES PATENT AND TRADEMARK OFFICE

CERTIFICATE OF CORRECTION

PATENT NO. : 4,346,360

DATED : August 24, 1982

INVENTOR(S) : Mark J. Del Tufo

It is certified that error appears in the above-identified patent and that said Letters Patent is hereby corrected as shown below:

Column 1, line 14, "pressure" should read -- presence --

Column 2, line 38, after "invention" insert -- will --

Signed and Sealed this

*Seventh* Day of *December 1982*

[SEAL]

*Attest:*

GERALD J. MOSSINGHOFF

*Attesting Officer*

*Commissioner of Patents and Trademarks*